US008012373B2

(12) United States Patent
Walsh

(10) Patent No.: US 8,012,373 B2
(45) Date of Patent: Sep. 6, 2011

(54) ANTI-CORROSION THREAD COMPOUND FOR SEAWATER ENVIRONMENT

(75) Inventor: Robert E. Walsh, North Kingstown, RI (US)

(73) Assignee: Raytheon Company, Waltham, MA (US)

( * ) Notice: Subject to any disclaimer, the term of this patent is extended or adjusted under 35 U.S.C. 154(b) by 347 days.

(21) Appl. No.: 12/454,093

(22) Filed: May 12, 2009

(65) Prior Publication Data

US 2010/0288978 A1 Nov. 18, 2010

(51) Int. Cl.

| | |
|---|---|
| ***C23F 11/18*** | (2006.01) |
| ***C23F 11/10*** | (2006.01) |
| ***C23F 11/08*** | (2006.01) |
| ***C10M 125/04*** | (2006.01) |

(52) U.S. Cl. ..... 252/389.52; 252/389.1; 252/400.1; 252/400.52; 106/14.05; 106/14.33; 106/14.39; 508/150

(58) Field of Classification Search ..... 252/389.52, 252/400.52; 508/150; 106/14.33, 14.39
See application file for complete search history.

(56) References Cited

U.S. PATENT DOCUMENTS

| | | | | |
|---|---|---|---|---|
| 2,417,428 | A * | 3/1947 | McLennan | 508/313 |
| 2,595,556 | A * | 5/1952 | Worth et al. | 508/396 |
| 3,172,760 | A | 3/1965 | Sakano et al. | |
| 3,418,230 | A | 12/1968 | Rutemiller | |
| 3,616,420 | A | 10/1971 | Broughton | |
| 3,660,288 | A * | 5/1972 | Hansen | 508/521 |
| 3,974,055 | A | 8/1976 | Reding et al. | |
| 4,157,991 | A | 6/1979 | Pilla | |
| 4,159,918 | A | 7/1979 | Von Bogdandy et al. | |
| 4,525,287 | A * | 6/1985 | Carstensen | 508/120 |
| 4,915,856 | A * | 4/1990 | Jamison | 508/103 |
| 5,034,291 | A | 7/1991 | Jacus | |
| 5,266,104 | A | 11/1993 | Vincent | |
| 5,348,668 | A | 9/1994 | Oldiges et al. | |
| 5,452,749 | A | 9/1995 | Johnson et al. | |
| 5,536,422 | A | 7/1996 | Oldiges et al. | |
| 6,331,509 | B1 | 12/2001 | Heimann et al. | |
| 6,734,147 | B2 * | 5/2004 | Levy | 508/103 |
| 7,553,541 | B2 * | 6/2009 | Levy | 428/375 |
| 7,718,585 | B2 * | 5/2010 | Levy | 508/116 |
| 2005/0197259 | A1 * | 9/2005 | Levy | 508/168 |
| 2006/0100342 | A1 | 5/2006 | Jensen | |
| 2007/0042533 | A1 * | 2/2007 | Endo et al. | 438/118 |
| 2007/0049694 | A1 | 3/2007 | Koch et al. | |
| 2010/0098956 | A1 * | 4/2010 | Sepeur et al. | 428/457 |
| 2010/0288978 | A1 * | 11/2010 | Walsh | 252/389.52 |

* cited by examiner

*Primary Examiner* — Joseph D Anthony
(74) *Attorney, Agent, or Firm* — Iandiorio Teska & Coleman

(57) ABSTRACT

An anti-corrosion compound including a hydrocarbon grease and an aluminum/indium/zinc powder blended into the hydrocarbon grease.

12 Claims, 2 Drawing Sheets

ANTI-CORROSION THREAD COMPOUND FOR SEAWATER ENVIRONMENT

FIELD OF THE INVENTION

This invention relates to an anti-corrosion thread compound and to a method of protecting threads of a bolt or other hardware from corrosion in seawater and, in particular, to a method for making and using an anti-corrosion thread compound for use on attaching hardware to aluminum assemblies.

BACKGROUND OF THE INVENTION

When exposed to seawater environments, parts made of galvanically disparate metals will quickly corrode. For example, stainless steel bolts (noble metal) attached to aluminum structures (base metal) in a seawater environment will cause the aluminum to quickly corrode. Similarly, aluminum structures (base metal) in contact with stainless steel bolts (noble metal) will quickly corrode in a seawater environment.

Various conventional thread compounds with, e.g., nickel, zinc, molybdenum, graphite, copper, silver powder additives, and the like, have been used in an attempt to prevent corrosion of the threads of the bolts of hardware assembly interfaces having galvanically disparate metals. However, such conventional thread compounds are, in themselves, typically galvanically incompatible with the components of the assembly and/or have limited efficiency.

Corrosion inhibiting compositions are also known. See, e.g., U.S. Pat. No. 5,266,104. As disclosed therein, a corrosion inhibiting composition for protecting threads of oil country tubular goods is used that includes a vapor phase corrosion inhibitor and a liquid phase corrosion inhibitor in a water solution. However, such a corrosion inhibitor is not effective in seawater environments.

BRIEF SUMMARY OF THE INVENTION

This invention features an anti-corrosion compound including a hydrocarbon grease and an aluminum/indium/zinc powder blended into the hydrocarbon grease.

In one embodiment, the hydrocarbon grease may be in the range of about 55% to about 80% by volume and the aluminum/indium/zinc powder may be in the range of about 45% to about 20% by volume. The hydrocarbon grease may be about 66.7% by volume and the aluminum/indium/zinc powder may be about 33.3% by volume. The aluminum/indium/zinc powder may be sieved to no greater than about 125 micron size particles. The hydrocarbon grease may include an aluminum complex hydrocarbon based waterproof grease. The hydrocarbon grease and the aluminum/indium/zinc powder may prevent corrosion in seawater environments.

This invention also features an anti-corrosion compound including about 55% to 80% by volume of a hydrocarbon grease, and about 45% to 20% by volume of an aluminum/indium/zinc powder.

In one embodiment, the hydrocarbon grease may be about 66.7% by volume and the aluminum/indium/zinc powder may be about 33.3% by volume.

This invention further features an anti-corrosion thread compound for a seawater environment including a hydrocarbon grease and an aluminum/indium/zinc powder blended into the hydrocarbon grease.

This invention further features a method for making an anti-corrosion compound including providing a hydrocarbon-based grease, providing an aluminum/indium/zinc powder, and mixing the hydrocarbon-based grease with the aluminum/indium/zinc powder.

In one embodiment, the hydrocarbon-based grease with the aluminum/indium/zinc powder may be about 55% to 80% volume and the aluminum/indium/zinc powder may be about 45% to 20% by volume. The hydrocarbon grease may be about 66.7% by volume and the aluminum/indium/zinc powder may be about 33.3% by volume. The aluminum/indium/zinc powder may be sieved to no greater than 125 micron size particles. The hydrocarbon grease may be an aluminum complex hydrocarbon based waterproof grease. The hydrocarbon grease and the aluminum/indium/zinc powder may prevent corrosion in a seawater environment.

This invention further features a method for making an anti-corrosion compound including providing a hydrocarbon grease at about 55% to 80% by volume providing an aluminum/indium/zinc powder at about 45% to 20% by volume, and mixing the hydrocarbon-based grease with the aluminum/indium/zinc powder.

In one embodiment, the hydrocarbon grease may be about 66.7% by volume and the aluminum/indium/zinc powder may be about 33.3% by volume.

This invention further features a method for making an anti-corrosion thread compound for a sea environment including providing a hydrocarbon-based grease, providing an aluminum/indium/zinc powder, and mixing the hydrocarbon-based grease with the aluminum/indium/zinc powder.

Additional objects, features and advantages of the invention will become apparent to those skilled in the art upon consideration of the following detailed description of the illustrated embodiment exemplifying the best mode of carrying out the invention as presently perceived.

BRIEF DESCRIPTION OF THE SEVERAL VIEWS OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and which includes the following.

DETAILED DESCRIPTION OF THE INVENTION

Figure 1:
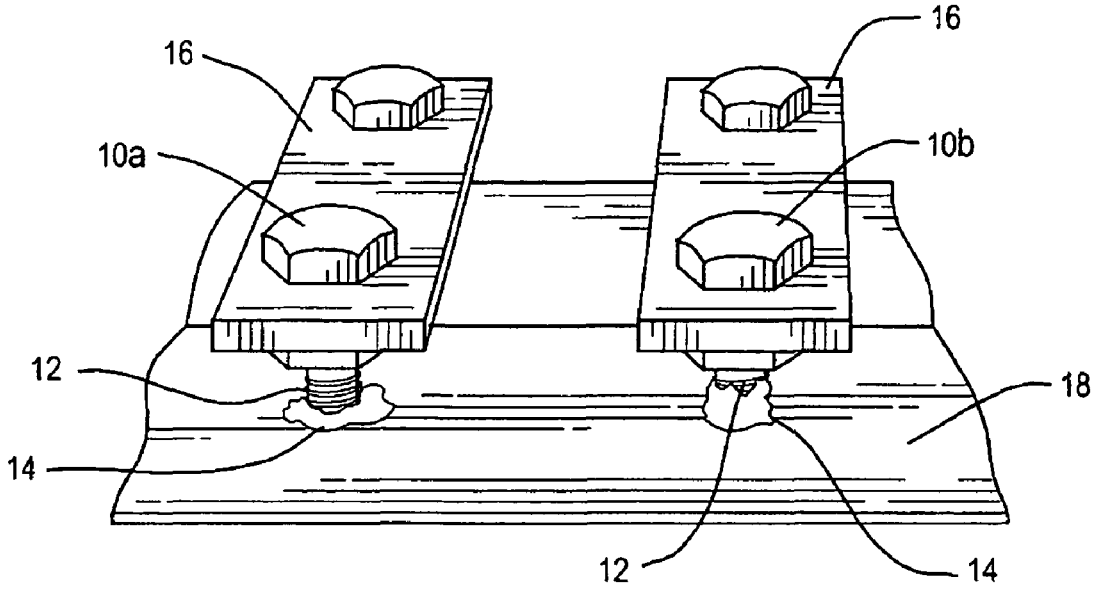
FIG. 1 illustrates an example of stainless steel bolts having a compound of the present invention spread on the threads and passing through a stainless steel plate and entered into a aluminum bar.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

The present invention includes an anti-corrosion compound 14 for use on the threads of bolts or other similar type hardware, which attach to component parts of varying alloys to underwater aluminum structures, e.g., threads 12 on bolts 10*a*, 10*b*, FIG. 1. In one example, anti-corrosion compound 14 may be applied to stainless steel bolts, or on other corrosion resistant type bolts, e.g., bolts made of nickel/chromium or nickel/cobalt alloys, and the like. Anti-corrosion compound 14 aides in mechanical joining by reducing or eliminating galling and retards or prevents corrosion between galvanically disparate metals up to about a two year minimum of seawater or ocean exposure as measured, in one example, by Marine Accelerated Life Test.

In one embodiment, anti-corrosion compound 14 comprises a mixture of about 66.7% by volume (2 parts) of an aluminum complex hydrocarbon based, waterproof grease, and about 33.3% by volume (1 part) of a powdered aluminum/indium/zinc alloy.

In other examples, anti-corrosion compound 14 may be a mixture of about 55% to 80% by volume of the aluminum complex hydrocarbon based, waterproof grease and about 45% to 20% by volume of the aluminum/indium/zinc powder. The aluminum/indium/zinc powder is preferably sieved/sized to about 125 micron (0.0049 inches) or finer and blended with the waterproof grease to a uniform consistency. The aluminum soap complex thickened, hydrocarbon based, waterproof grease may be embodied by part No. 9500 manufactured by Bel-Ray Company, Inc. of Farmingdale, N.J. In one example, the powder may be obtained by grinding an anode, manufactured by Performance Metals, Inc. of Bechtelsville, Pa. and referred to as a Navalloy™ anode, with miniature sanding drums, although one skilled in the art will recognize that there are other efficient ways to produce the metal powder. The resulting powder is sieved and poured through the 125 micron sieve.

The Navalloy™ anode meets MIL-DTL-24779A (SH) "Anodes Sacrificial Aluminum Alloy," Table 1, Chemical Composition (by weight) as follows:

| | |
|---|---|
| Indium | 0.014-0.020% |
| Zinc* | 4.0-6.5% |
| Silicon | 0.08-0.20% |
| Copper | 0.004% Max. |
| Iron | 0.090% Max. |
| Mercury | 0.001% Max. |
| Tin | 0.001% Max. |
| Aluminum* | Remainder |

*Aluminum and zinc raw material purity shall be 99.8% by weight (minimum).

Figure 2:
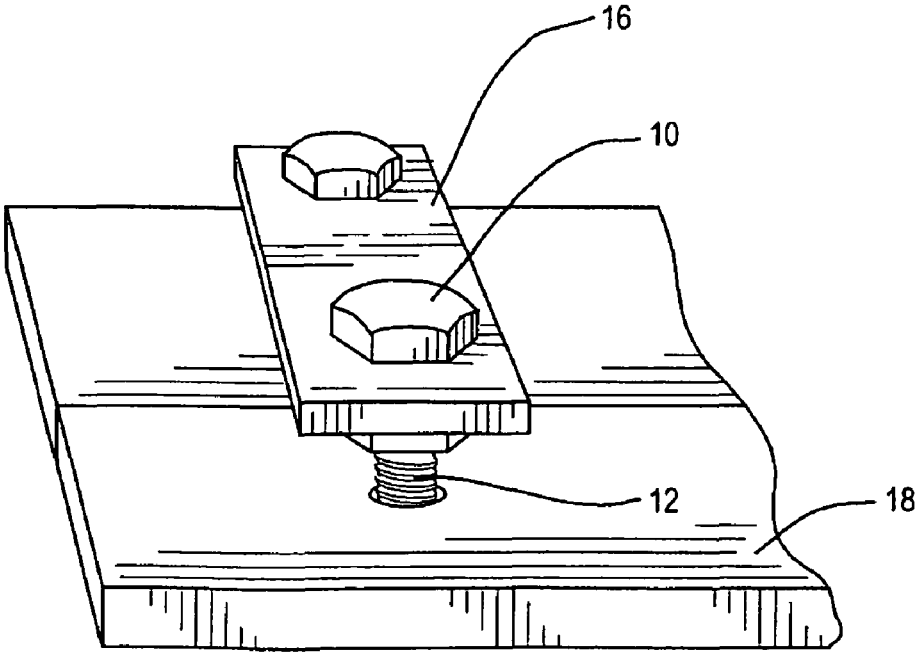
FIG. 2 shows the bolt of FIG. 1 without the compound of the present invention entered into the aluminum bar.

FIG. 1 shows an example of Type 316 (Unified Numbering System (UNS)-S31600) stainless steel bolts 10*a*, 10*b* passing through a Type 304 (UNS-S30400) stainless steel plate 16 and entered into a 6061-T6 (UNS A96061) aluminum bar 18 which has been drilled and tapped to accept Type 304 (UNS-S30400) stainless steel, helically coiled, threaded (Helicoil™ typical Emhart Teknologies, Sheldon, Conn.) inserts to receive the bolts 10*a*, 10*b*. There is electrical continuity between the bolts 10*a*, 10*b*, plate 16 and aluminum bar 18. Applied to threads 12 of bolts 10*a*, 10*b* is anti-corrosion compound 14 of this invention. In this example, threads 12 on bolt 10*a* are partially covered for test purposes with anti-corrosion compound 14 to expose some of the threads 12 and threads 12 on the bolt 10*b* are mostly covered with anti-corrosion compound 14. In actual use, threads 12 of the bolts 10*a*, 10*b* would usually be completely within the bar 18. The bolts 10*a*, 10*b* are typically corrosion resistant steel bolts, although this is not a limitation of this invention as bolts 10*a*, 10*b* may also be made of other similar type materials as known to those skilled in the art. The aluminum bar 18 is typically over-all hard-coated anodized per MIL-A-8625 Type 111, Class 2 and painted on one side with MIL-DTL-24441/29 epoxy-polyamide primer about 4-6 mils thick and having a top coat of Mil-PRF-22750 epoxy 3 to 5 mils thick; the other side of bar 18 is left bare anodized. FIG. 2 shows an example of an untreated control sample with bolt 10 entered into the aluminum bar 18 without the anti-corrosion compound 14 applied to threads 12.

Figure 3:
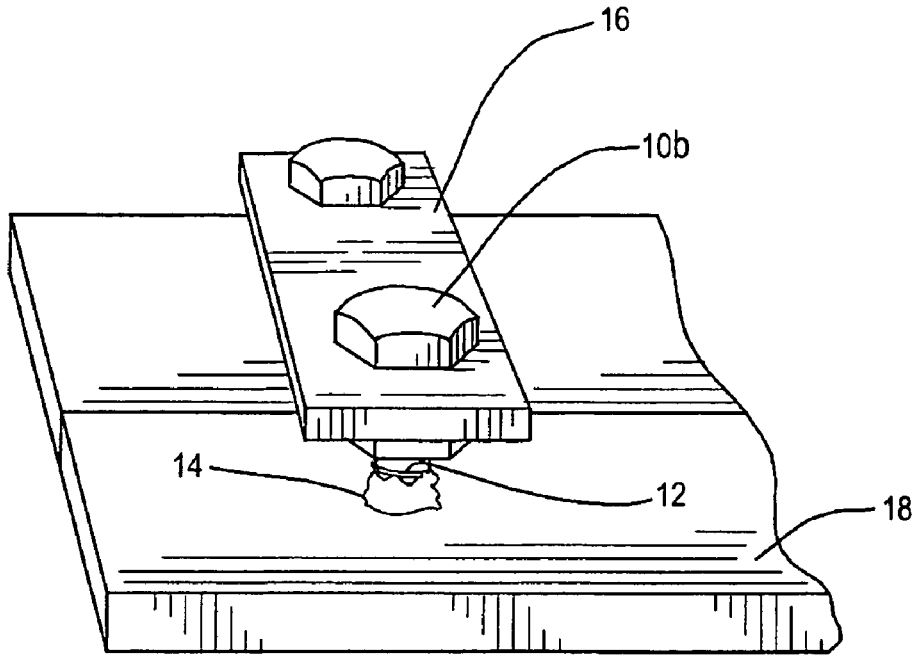
FIG. 3 illustrates the bolt of FIG. 1 having no corrosion or paint blistering adjacent to the bolt after a marine accelerated life test of two equivalent years.

Referring now to FIG. 3, bolt 10*b* of FIG. 1 is illustrated having the anti-corrosion compound 14 applied to threads 12. As shown, no corrosion or paint blistering adjacent to bolt 10*b* was found after a Marine Accelerated Life Test (MALT) of two years of equivalent ocean exposure. The MALT accelerates permeation driven reactions with the use of hot artificial saltwater. The dissolved oxygen level of the water during MALT is maintained at a saturated level by recirculation pumps and air-stone diffusion. The pH is kept at typical oceanic levels (8.2) and salinity is kept at 3.2%-3.5%. The test system is visually reviewed at each 6-month equivalency. Previous MALT assessments performed on organic coatings (paint systems, polyurethane encapsulations, and rubber vulcanizates) indicate a repeatable acceleration factor of 27:1 for various failure mechanisms at an established temperature.

Figure 4:
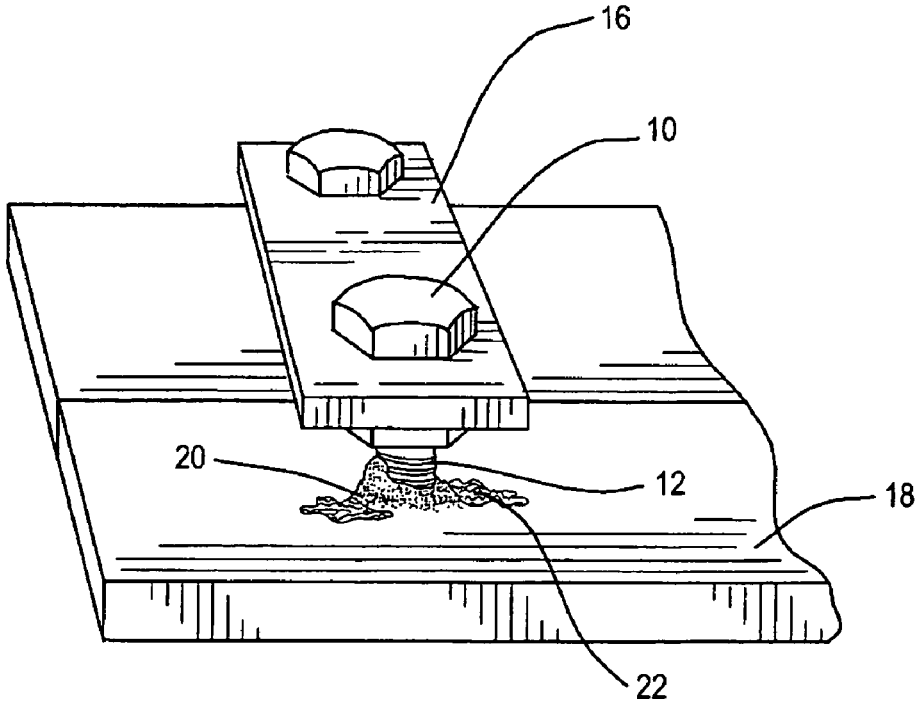
FIG. 4 illustrates the bolt of FIG. 2 having corrosion and paint blistering adjacent to the bolt after a marine accelerated life test of two equivalent years.

Referring to FIG. 4, as early as the first equivalent six months (about 7 days), aluminum corrosion products 20 and blistering of the paint 22 were evident in the untreated control sample shown in FIG. 2. As shown in FIG. 4, the untreated paint side sample of FIG. 2 continued to further degrade out to the second equivalent year. By the first equivalent year (13.5 days), the untreated control sample began producing corrosion products on the anodized side. Therefore, it was determined that the control or untreated samples corrode at a rate similar to fielded equipment (approximately 6 months). It was determined that adding just a waterproof grease increases corrosion resistance, but only up to about one year. By filling the same grease with aluminum/indium/zinc powder, the corrosion resistance is increased by at least a factor of two.

This invention has been disclosed in terms of a certain embodiment. It will be apparent that many modifications can be made to the disclosed method, such as forming the aluminum/indium/zinc powder, without departing from the invention. Therefore, it is the intent of the appended claims to cover all such variations and modifications as come within the true spirit and scope of this invention.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An anti-corrosion composition comprising:

about 55% to 80% by volume of a hydrocarbon grease; and about 45% to 20% by volume of an aluminum/indium/zinc powder blended into said hydrocarbon grease.

2. The composition of claim 1 wherein the hydrocarbon grease is about 66.7% by volume and the aluminum/indium/zinc powder is about 33.3% by volume.

3. The composition of claim 1 wherein said aluminum/indium/zinc powder is sieved to no greater than about 125 micron size particles.

4. The composition of claim 1 in which the hydrocarbon grease includes an aluminum complex hydrocarbon based waterproof grease.

5. The composition of claim 1 in which the hydrocarbon grease and the aluminum/indium/zinc powder prevent corrosion in seawater environments.

6. An anti-corrosion thread composition for seawater environment comprising:

about 55% to 80% by volume of a hydrocarbon grease; and about 45% to 20% by volume of an aluminum/indium/zinc powder blended into said hydrocarbon grease.

7. A method for making an anti-corrosion composition comprising:

providing a hydrocarbon grease at about 55% to 80% by volume;

providing an aluminum/indium/zinc powder at about 45% to 20% by volume; and mixing the hydrocarbon-based grease with the aluminum/indium/zinc powder.

8. The method of claim 7 wherein the hydrocarbon grease is about 66.7% by volume and the aluminum/indium/zinc powder is about 33.3% by volume.

9. The method of claim 7 wherein said aluminum/indium/zinc powder is sieved to no greater than 125 micron size particles.

10. The method of claim 7 in which the hydrocarbon grease is an aluminum complex hydrocarbon based waterproof grease.

11. The method of claim 7 in which the hydrocarbon grease and the aluminum/indium/zinc powder prevent corrosion in a seawater environment.

12. A method for making an anti-corrosion thread composition for a sea environment comprising:

providing a hydrocarbon grease at about 55% to 80% by volume;

providing an aluminum/indium/zinc powder at about 45% to 20% by volume; and mixing the hydrocarbon-based grease with the aluminum/indium/zinc powder.

* * * * *